United States Patent [19]

Vig et al.

[11] 4,028,135

[45] June 7, 1977

[54] METHOD OF CLEANING SURFACES BY IRRADIATION WITH ULTRAVIOLET LIGHT

[75] Inventors: John R. Vig, Colts Neck; John W. LeBus, Farmingdale, both of N.J.

[73] Assignee: The United States of America as represented by the Secretary of the Army, Washington, D.C.

[22] Filed: Apr. 22, 1976

[21] Appl. No.: 671,798

[52] U.S. Cl. ..... 134/1; 134/26; 134/30; 134/40

[51] Int. Cl.[2] ..... B08B 3/10

[58] Field of Search ..... 134/1, 6, 30, 40, 26; 21/74 R, 74 A, 54 R, 102 R, DIG. 2; 250/455, 504

[56] References Cited

UNITED STATES PATENTS

| | | | |
|---|---|---|---|
| 2,095,502 | 10/1937 | Johnston | 134/1 |
| 3,516,861 | 6/1970 | Menkes et al. | 134/1 |
| 3,881,949 | 5/1975 | Brock | 134/40 X |
| 3,898,351 | 8/1975 | Kennison et al. | 134/1 X |
| 3,914,836 | 10/1975 | Hafner et al. | 250/504 X |

OTHER PUBLICATIONS

Sowell et al., "Surface Cleaning by Ultraviolet Radiation", *J. Vac. Sci. Tech.*, vol. 11, No. 1, Jan./Feb. 1974, pp.474–475.

Luckiesh, *Applications of Germicidal, Erythemal and Infrared Energy*, 1946, p. 195.

*Primary Examiner*—S. Leon Bashore
*Assistant Examiner*—Marc L. Caroff
*Attorney, Agent, or Firm*—Nathan Edelberg; Sheldon Kanars; Roy E. Gordon

[57] ABSTRACT

Contaminants are rapidly removed from surfaces by precleaning the surfaces in air, and then irradiating the surfaces with shortwave ultraviolet light in the presence of oxygen.

12 Claims, No Drawings

METHOD OF CLEANING SURFACES BY IRRADIATION WITH ULTRAVIOLET LIGHT

BACKGROUND OF THE INVENTION

This invention relates in general to a method of removing contaminants from surfaces and in particular, to a simple, rapid, and effective method of removing from the surface of a quartz resonator a variety of contaminants with which a quartz resonator may possibly come into contact during processing.

It has been recognized in the art that ultraviolet radiation can be used for surface cleaning. That is, in the article "Surface Cleaning By Ultraviolet Radiation" by R. R. Sowell, R. E. Cuthrell, D. M. Mattox, and R. D. Bland appearing in the Journal of Vacuum Science and Technology, Vol. 11, pages 474 to 475, Jan/Feb 1974, and in the article "Surface Cleaning in Thin Film Technology" by D. M. Mattox appearing as a Sandia Laboratory Report SAND 74-0344, Jan. 1975, the authors teach the use of ultraviolet radiation in air to remove contamination from a surface. The use of ultraviolet radiation suggested by the article is not altogether satisfactory in that it requires moving filtered air and takes about 15 hours to work. Moreover, there is no mention of the wavelengths of the ultraviolet radiation to be used, or the need for precleaning.

U.S. Pat. No. 3,914,836, issued Oct. 28, 1975 to Erich Hafner and John R. Vig teaches the use of ultraviolet radiation in the processing of precision quartz crystal resonators. However, the U.S. Pat. No. 3,914,836 method is not completely satisfactory in that the irradiation with ultraviolet must be carried out in an expensive and complex high vacuum system.

SUMMARY OF THE INVENTION

The general object of this invention is to provide a method of rapidly removing contaminants from surfaces. A more particular object of the invention is to provide such a method for effectively removing a variety of contaminants with which a quartz resonator may possibly come into contact during processing.

The foregoing objects have been attained by a method involving precleaning the surface in air and then irradiating the surface with shortwave ultraviolet light in the presence of oxygen.

According to the invention, the best results in many cases are achieved with a solvent precleaning in air followed by irradiation in air with short wavelength ultraviolet light. This procedure is highly effective in removing a variety of contaminants particularly from quartz resonator surfaces. The method is a dry process that is simple to use and inexpensive to set up and operate. For surfaces which are properly precleaned and placed within a few millimeters of an ozone producing ultraviolet source, the method can consistently produce a clean surface in less than 1 minute.

The initial precleaning step is carried out to remove gross contamination and inorganic contamination which may not be removed by short wavelength ultraviolet light and ozone. For a general type of contamination, the initial precleaning step is preferably carried out in a mixture of polar and nonpolar solvent, such as an azeotrope of trichlorotrifluoroethane and ethyl alcohol, plus a rinse in ultrapure water followed by spin drying. For the contamination ordinarily found in quartz resonator fabrication, a particularly effective precleaning procedure has been found to involve:

scrubbing the surface with a swab while the surface is immersed in ethyl alcohol; then, agitating ultrasonically in fresh ethyl alcohol; then boiling in fresh ethyl alcohol, then agitating ultrasonically while the alcohol is hot; then, rinsing in running ultrapure (18 M$\pi$cm) water; and finally, spinning dry immediately after the running water rinse.

Following the precleaning step, cleaning is carried out by irradiation with short wavelength ultraviolet light in the presence of oxygen. At least one of the particular short wavelengths emitted by the ultraviolet lamp used must be short enough to be strongly absorbed by oxygen so as to generate ozone, i.e., below 2000 angstroms. The wavelength of ultraviolet light used must also be of such magnitude as to be absorbed by the contaminants which are to be removed, which is generally from 2000 to 3000 angstroms. Two wavelengths that are particularly desirable are 2537 angstroms and 1849 angstroms. The 2537 angstrom wavelength is important because it is absorbed by most contaminants. The 1849 angstrom line is absorbed by oxygen, and it thus generates ozone. The 2537 angstrom line does not generate ozone. The ultraviolet source for the 1849 angstrom line and the 2537 angstrom line can conveniently be low pressure mercury discharge tubes in fused quartz envelopes.

BRIEF DESCRIPTION OF THE PREFERRED EMBODIMENT

A quartz resonator is precleaned according to the procedure heretofore described. The quartz resonator is then irradiated with shortwave ultraviolet light in a suitable ultraviolet cleaning box. The particular box used in this embodiment is made of aluminum, which is a good reflector of ultraviolet light, and contains a low pressure mercury discharge lamp and an aluminum stand with polished aluminum reflectors. The lamp produces about 1.6 milliwatts per square centimeter of ultraviolet light for a sample 1 centimeter from the tube. The box also contains room air. The tube of the ultraviolet lamp in the box consists of 91 centimeters of "hairpin bent" fused quartz which transmits both the 2537 angstrom line and the 1849 angstrom line. The lamp emits about 0.1 milliwatt per square centimeter at 1849 angstroms. In this embodiment, the quartz resonators are exposed simultaneously to 2537 angstroms, 1849 angstroms, and the ozone generated by the 1849 angstroms. When placed within 5 millimeters of the ultraviolet source, after exposure for 60 seconds, the quartz resonator surfaces are found to be clean when evaluated by standard cleaning tests as for example, contact angle measurement and Auger Electron Spectroscopy.

EXAMPLE 2

Quartz wafers are thoroughly contaminated with human skin oils, one of the most difficult contaminants to remove. The wafers are then precleaned as above described and then irradiated with ultraviolet light and ozone as in the preferred embodiment. The wafers are found to be clean after 20 seconds of irradiation. However, when the same experiment is performed without any precleaning, even prolonged exposure to the ultraviolet and ozone does not produce a clean surface.

EXAMPLE 3

A quartz wafer is again precleaned according to the method described. The wafer is then placed in a suitable ultraviolet cleaning box. The particular box used in the Example is made of aluminum and contains a low pressure mercury discharge lamp and an aluminum stand with polished aluminum reflectors. The lamp produces about 1.6 milliwatts per square centimeter of ultraviolet light for a sample 1 centimeter from the tube. The box also contains clean air. The lamp in this box has two 46 centimeters long, straight, high silica glass tubes. The glass transmits at 2537 angstroms but not at 1849 angstroms. Since this lamp generates no measurable ozone, a separate Siemens type ozone generator is built into the box. This ozone generator does not emit ultraviolet light. Ozone is produced by a "silent" discharge gap formed by two concentric glass tubes, each of which is wrapped in aluminum foil electrodes. The ozone generating tube is parallel to the ultraviolet tubes, approximately 6 centimeters away. This ultraviolet cleaning box thus offers the options of exposing samples to: 2537 angstroms plus ozone, of 2537 angstroms only, or ozone only.

When the quartz wafers are exposed to 2537 angstroms plus ozone in this box, the wafers are found to be clean after 90 seconds. Samples exposed to 2537 angstroms without ozone take one hour to be cleaned, and samples exposed to ozone without ultraviolet take 10 hours to be cleaned.

EXAMPLE 4

The effectiveness of the cleaning procedures described in the preferred embodiment is tested on a variety of contaminants with which a quartz resonator may possibly come into contact during processing. The contaminants are:

1. A cutting oil used with a diamond saw
2. A beeswax and rosin mixture used to cement the crystals into a loaf during the rounding operation
3. A lapping vehicle
4. A mechanical vacuum pump oil
5. A silicone diffusion pump oil
6. A silicone vacuum grease
7. An acid (solder) flux
8. A rosin flux from a rosin core lead-tin solder
9. Contamination adsorbed during prolonged exposure to air
10. An organic diffusion pump oil In the method, the contaminants are applied to clean polished quartz and gold samples. After the contamination, the samples are precleaned, and then placed within a few millimeters of the tube and exposed to ultraviolet light ozone according to the method of the preferred embodiment. When tested with a standard steam test to measure contact angle, after 60 seconds of exposure, all quartz samples are shown to be clean as evidenced by good or excellent fringes. Since the cleanliness of gold cannot be checked by contact angle measurements, the cleanliness of the gold samples are checked by Auger Electron Spectroscopy, which indicate that all contaminants had been removed from the gold samples.

It can be seen from the foregoing examples that while both ultraviolet without ozone, and ozone without ultraviolet can produce a slow cleaning effect, the combination of short wavelength ultraviolet and ozone such as is obtained from a quartz-ultraviolet lamp, produces a clean surface substantially faster.

Another variable which can greatly affect the cleaning rate is the distance between the sample and the ultraviolet source. Because of the shapes of the ultraviolet tubes and of the polished aluminum reflectors above the tubes and below the samples, the lamps in the box in the preferred embodiment, and the lamp in the box in Example 3 are essentially plane sources. It is therefore to be expected that the intensity of ultraviolet light reaching a sample will be nearly independent of distance. This is not true however where ozone is present, because ozone has a broad absorption band centered at 2600 angstroms. At 2537 angstroms, the absorpiton coefficent is $130 cm^{-1} atm^{116\ 1}$. The intensity, I, of 2537 angstrom radiation reaching a smaple therefore decreases as $I = I_o e^{-130pl}$, where $p$ is the average ozone pressure between the sample and the ultraviolet source in atmospheres at 0° C., and $l$ is the distance to the sample in centimeters. Because the 1849 angstrom line is abosrbed by oxygen, when a quartz-ultraviolet tube is used, the ozone concentration is highest near the ultraviolet tube. The foregoing effect is illustrated in the following example.

EXAMPLE 5

Two sets of identically precleaned samples are placed in the ultraviolet cleaning box described in Example 3. The first set of samples are placed within 5 millimeters of the ultraviolet tube, the other set at the bottom of the box, about 8 centimeters from the tube. With the ozone generator off, there is less than 30 percent difference in the time it takes for the two sets of samples to be cleaned; that is, about 60 minutes versus 75 minutes. When the experiment is repeated with the ozone generator on, the samples near the bottom of the box take nearly ten times as long to be cleaned as the samples near the tube; that is, about 13 minutes versus 90 seconds. Similarly, in the ultraviolet box described in the preferred embodiment, samples placed within 5 millimeters of the tube clean up in 20 seconds versus 20 to 30 minutes for samples placed near the bottom of the box, 13 centimeters away.

In setting up an ultraviolet cleaning facility, it is therefore necessary to choose an ultraviolet source that will generate enough ultraviolet and ozone to allow for rapid photosensitized oxidation of contaminants, but not generate so much ozone as to absorb most of the ultraviolet before it reaches the samples.

EXAMPLE 6

Several oxide forming metal samples such as nickel, copper, and silver are precleaned according to the method heretofore described and then placed in the ultraviolet cleaning box described in the preferred embodiment. The metal samples are then irradiated with ultraviolet light and ozone as in the preferred embodiment. The metal samples are found to be clean in less than one minute.

The principal advantage of the method of the invention over the prior art is the shortness of time required to achieve a clean surface, that is, less than one minute as compared to the 15 hours shown in the prior art. This is particularly important in production applications, as for example, attaching gold wires to microcircuits by theremocompression bonding, where the cleaning must take place rapidly if it is to be of practical use.

EXAMPLE 7

The metal samples of Example 6 are exposed to ultraviolet radiation for several hours as is suggested by the prior art. After one hour, the silver sample turns black and the other metal samples start to show signs of corrosion. However, in the one minute or less which is required to clean a properly precleaned surface, as described herein, the corrosion problem is negligible. The rate of corrosion increases substantially when a beaker of water is placed in the ultraviolet box to increase the humidity. The corrosion upon extended exposure can be explained by the fact that, in the presence of shortwave ultraviolet, impurities in the air such as oxides of nitrogen and water vapor combine to form a corrosive atmosphere such as one which contains nitric acid vapors. For extended storage of clean metal parts, the use of controlled atmospheres in the ultraviolet box is necessary. Such controlled atmospheres include pure oxygen instead of air or a mixture of pure oxygen and pure argon instead of air.

In the construction of an ultraviolet cleaning facility, one should be aware of the safety hazards associated with shortwave ultraviolet light. Exposure to intense shortwave ultraviolet can cause serious skin and eye injury within a short time. For the ultraviolet boxes used in the above experiments, switches are attached to the doors in such a manner that when the doors are opened, the ultraviolet lamps are shut off automatically.

Another safety hazard is ozone, which is highly toxic. In setting up an ultraviolet cleaning facility, one must assure that the ozone levels to which people are exposed do not exceed 0.1 ppm, the standard set by the Occupational, Safety and Health Act.

A convenient method of assuring that people are not exposed to dangerous levels of ozone is to enclose two shortwave ultraviolet sources in an air tight aluminum box. One source would be an ozone generating ultraviolet lamp, such as a low pressure mercury light in a fused quartz envelope. The other shortwave ultraviolet source would be one that does not generate ozone, such as a low pressure mercury tube in a high silica glass tube. Since ozone has a very high absorption coefficient at 2537 angstroms, the non-ozone generating ultraviolet source could serve to rapidly destroy the ozone in the aluminum box.

For example, the precleaned sample would be placed in the aluminum box, and the ozone producing ultraviolet source would be turned on. After one minute, this source would be turned off and the other source turned on for about one minute to destroy the ozone in the box.

We wish it to be understood that we do not desire to be limited to the exact details shown and described, for obvious modifications will occur to a person skilled in the art.

What is claimed is:

1. Method of removing contaminants from surfaces including the steps of:

A. precleaning the surfaces with solvents; then rinsing in running ultrapure water; and finally, spinning dry immediately after the running water rinse; said precleaning also being carried out under an atmosphere of air;

B. placing the precleaned surfaces within about 5 millimeters of a lamp which emits short wavelength ultraviolet light that generates ozone in an oxygen containing atmosphere and that contains at least one wavelength between about 2000 angstroms and about 3000 angstroms; and irradiating the placed surfaces in an oxygen containing atmosphere with said short wavelength ultraviolet light from said lamp for about one minute.

2. Method according to claim 1 wherein the short wavelength ultraviolet light contains at least one wavelength shorter than about 2000 angstroms, and at least one wavelength between about 2000 angstroms and about 3000 angstroms.

3. Method according to claim 2 wherein the short wavelength ultraviolet light contains wavelengths of about 1849 angstroms and about 2537 angstroms.

4. Method according to claim 1 wherein the lamp is a low pressure mercury discharge lamp in a fused quartz envelope.

5. Method according to claim 1 wherein the surfaces to be cleaned and the lamp are enclosed in an aluminum box.

6. Method according to claim 1 wherein the short wavelength ultraviolet light used is about 2537 angstroms and wherein ozone is provided by a separate ozone generator.

7. Method according to claim 1 wherein the surface is a quartz resonator, wherein the contaminants removed are selected from the group consisting of human skin oils, a cutting oil used with a diamond saw, a beeswax and rosin mixture used to cement the crystals into a loaf during a rounding operation, a lapping vehicle, a mechanical vacuum pump oil, a silicone diffusion pump oil, an organic diffusion pump oil, a silicone vacuum grease, an acid flux, a rosin flux, and contamination absorbed during prolonged exposure to air, and wherein said contaminants are removed after 60 seconds of irradiation.

8. Method according to claim 1 wherein the surface to be cleaned is gold.

9. Method according to claim 5 wherein the surface to be cleaned is an oxide forming metal, and wherein the oxygen containing atmosphere is controlled to be free of impurities which can combine in the presence of ultraviolet radiation to produce a corrosive atmosphere.

10. Method according to claim 1 wherein the oxygen containing atmosphere is a mixture of pure oxygen and pure argon.

11. Method according to claim 1 wherein the oxygen containing atmosphere is air.

12. Method according to claim 5 wherein a second lamp is enclosed in said box which generates short wavelength ultraviolet light that does not generate ozone.

* * * * *